US009920628B2

(12) United States Patent
Rice

(10) Patent No.: US 9,920,628 B2
(45) Date of Patent: Mar. 20, 2018

(54) STEAM TURBINE WITH RESONANCE CHAMBER

(71) Applicant: ALSTOM Technology Ltd, Baden (CH)

(72) Inventor: Timothy Stephen Rice, Warwickshire (GB)

(73) Assignee: General Electric Technology GmbH, Baden (CH)

( * ) Notice: Subject to any disclaimer, the term of this patent is extended or adjusted under 35 U.S.C. 154(b) by 276 days.

(21) Appl. No.: 14/662,531

(22) Filed: Mar. 19, 2015

(65) Prior Publication Data

US 2015/0267538 A1 Sep. 24, 2015

(30) Foreign Application Priority Data

Mar. 24, 2014 (EP) ..... 14161231

(51) Int. Cl.

| | |
|---|---|
| ***F01D 5/10*** | (2006.01) |
| ***F01D 5/30*** | (2006.01) |
| ***F01D 5/06*** | (2006.01) |
| ***F01D 25/04*** | (2006.01) |

(52) U.S. Cl.

CPC ..... *F01D 5/10* (2013.01); *F01D 5/06* (2013.01); *F01D 5/30* (2013.01); *F01D 25/04* (2013.01); *F05D 2220/31* (2013.01); *F05D 2240/24* (2013.01); *F05D 2260/963* (2013.01)

(58) Field of Classification Search

CPC ..... F01D 5/10; F01D 5/06; F01D 5/30; F01D 25/04; F01D 25/06; F01D 25/32

USPC ..... 415/119, 169.1, 169.2, 169.4, 168.1

See application file for complete search history.

(56) References Cited

U.S. PATENT DOCUMENTS

| | | | | |
|---|---|---|---|---|
| 4,722,668 | A | 2/1988 | Novacek | |
| 4,878,810 | A | 11/1989 | Evans | |
| 5,261,785 | A * | 11/1993 | Williams | F01D 25/32 415/169.2 |
| 7,992,674 | B2 * | 8/2011 | Gorny | F04D 29/663 181/225 |
| 8,419,354 | B2 * | 4/2013 | Sakai | F01D 5/225 415/169.4 |
| 2009/0082976 | A1 * | 3/2009 | Anuzis | G01M 15/14 702/35 |
| 2010/0189546 | A1 | 7/2010 | Liu et al. | |
| 2013/0280050 | A1 | 10/2013 | Ansari et al. | |

FOREIGN PATENT DOCUMENTS

| | | | | |
|---|---|---|---|---|
| EP | 1 559 874 | A1 | 8/2005 | |
| EP | 1559874 | A1 * | 8/2005 | F01D 25/04 |
| EP | 2 623 732 | A1 | 8/2013 | |

OTHER PUBLICATIONS

Stueer, Heinrich; Mar. 8, 2005; "EP155987MT Stueer.jpg" Machine translation of EP 1559874 A1.*

First Office Action and Search issued in connection with corresponding CN Application No. 201510129394.5 dated May 18, 2017.

* cited by examiner

*Primary Examiner* — Woody Lee, Jr.

(74) *Attorney, Agent, or Firm* — GE Global Patent Operation; Cynthia W. Flanigan

(57) ABSTRACT

A steam turbine with a resonance chamber in the outer annulus opposite a rotating blade row. The resonance chamber provides passive resonance to place the excitation at a frequency away from the natural frequency of the blades.

6 Claims, 1 Drawing Sheet

STEAM TURBINE WITH RESONANCE CHAMBER

CROSS-REFERENCE TO RELATED APPLICATIONS

This application claims priority to European application 14161231.7 filed Mar. 24, 2014, the contents of which are hereby incorporated in its entirety.

TECHNICAL FIELD

The present disclosure relates generally to steam turbine and more specifically for system to reduced steam turbine blade vibration.

BACKGROUND

Turbine blades, because of their complex design, can suffer from vibration at frequencies which correspond to natural frequencies of the blades called modes. Each mode is associated with a different type of vibration such as along the rotational axis of the turbine, perpendicular to the rotational axis of the turbine, etc. To prevent excessive vibration of the blade about its normal position, normal design practice dictates that the blades are constructed such that those modes are located between harmonics of the operating frequency of the steam turbine. However, manufacturing tolerances, changes in blade attachment to the rotor, changes in blade geometry due to erosion and changes in the operating frequency of the turbine, among other factors, cause mode frequencies to approach harmonics of the operating frequency. Additionally, damaging nonsynchronous vibration may also occur. Typically, nonsynchronous vibration in a steam turbine may occur as a result of buffeting wherein a low steam flow and a high back pressure cause the random excitation of the turbine blades or as a result of turbine rotor torsional stresses.

While various methods of suppressing vibration are known including, for example, magnetic coupling as discussed in U.S. Pat. No. 4,722,668, fluid injection as discussed in U.S. 2013/0280050 and blade tuning as discussed in U.S. Pat. No. 4,878,810, there is nonetheless a need for alternative vibration prevention methods.

SUMMARY

A steam turbine blade vibration suppression system is disclosed.

It attempts to addresses this problem by means of the subject matters of the independent claims. Advantageous embodiments are given in the dependent claims.

The disclosure is based on the general idea of locating a passive resonator, such as a Helmholtz resonator axially above the rotating part of the blade so as to change the excitation frequency.

An aspect provides a steam turbine with a rotor and a circumferentially distributed row of rotating blades extending radially from a root attached to the rotor to a tip portion. An outer annulus circumferentially encloses the row of rotating blades. The steam turbine further includes a resonance chamber having an opening in a region of the outer annulus defined by a radial projection of the root of the blades onto the outer annulus opposite a tip region of the blades. These locations enable the resonator to change the excitation frequency of the blade row.

An aspect comprises a plurality of circumferentially distributed resonance chambers.

In an aspect the resonance chamber is preferably configured for a frequency between 2.5 to 6 engine orders and more preferably for a frequency between 3 to 5 engine orders.

In an aspect, the resonance chamber is configured as a Helmholtz resonator.

In an aspect the steam turbine is a multi-stage steam turbine having a downstream last stage wherein the row of blades where the opening of the resonance chamber is located is last stage blades. The steam turbine may be a low pressure steam turbine configured to operate with an exhaust pressure of at or below ambient pressure.

It is a further object of the invention to overcome or at least ameliorate the disadvantages and shortcomings of the prior art or provide a useful alternative.

Other aspects and advantages of the present disclosure will become apparent from the following description, taken in connection with the accompanying drawings which by way of example illustrate exemplary embodiments of the present invention.

BRIEF DESCRIPTION OF THE DRAWINGS

By way of example, an embodiment of the present disclosure is described more fully hereinafter with reference to the accompanying drawings, in which.

DETAILED DESCRIPTION

Figure 1:
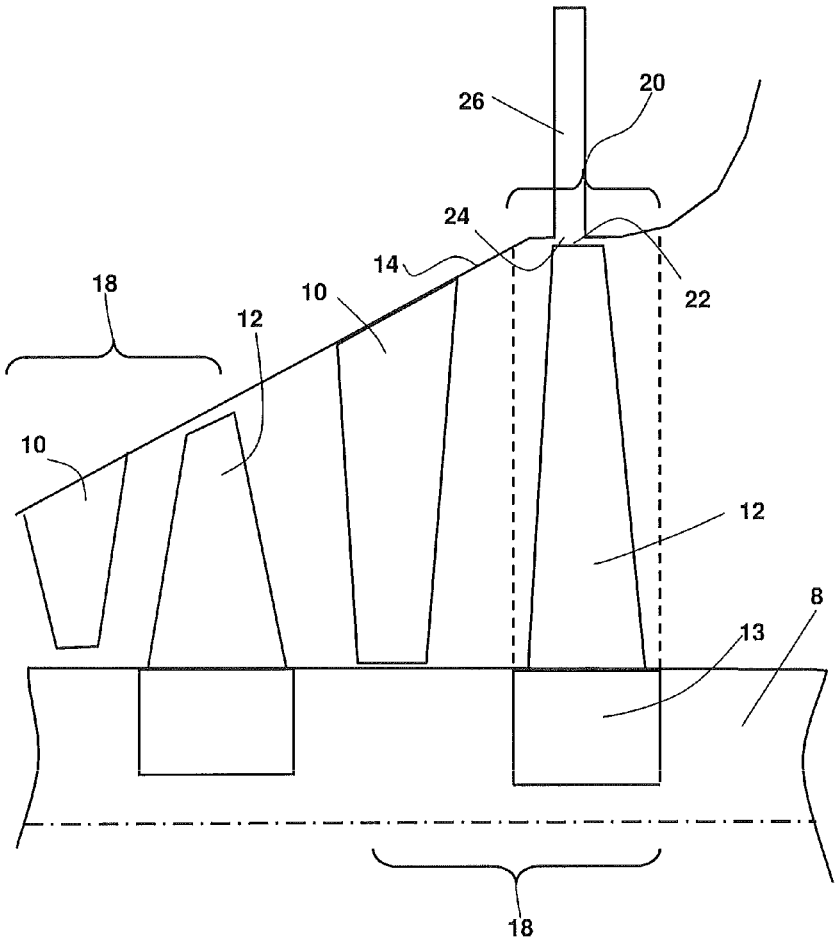
FIG. 1 is a schematic view of a steam turbine of a preferred embodiment having a resonance chamber.

Exemplary embodiments of the present disclosure are now described with references to the drawings, wherein like reference numerals are used to refer to like elements throughout. In the following description, for purposes of explanation, numerous specific details are set forth to provide a thorough understanding of the disclosure. However, the present disclosure may be practiced without these specific details, and is not limited to the exemplary embodiment disclosed herein.

In an exemplary embodiment, as shown in FIG. 1 comprises a steam turbine have a rotor 8, a circumferentially distributed rotating row of blades 12 extending radially from a root 13, attached to the rotor 8 to a tip portion 22, and an outer annulus 14 circumferentially enclosing the row of blades 12 to form an outer annulus 14. A stage 18 of the steam turbine is defined as a combination of a stationary row of vanes 10 and a rotating row of blades 12. Such a steam turbine is may be used for power generation.

In an exemplary embodiment shown in FIG. 1 is a multi-stage steam turbine, wherein the last stage 18 is defined as the downstream stage of the multi-stage 18 steam turbine.

In an exemplary embodiment, the steam turbine is a low pressure steam turbine defined by having an exhaust pressure at or below ambient pressure.

An exemplary embodiment, shown in FIG. 1 includes a resonance chamber 26 having an opening 24 in the outer annulus 14 in a region of the annulus 14 defined by a radial projection 20 of the roots 13 of the blades 12 on to the annulus 14. In another exemplary embodiment the opening 24 is opposite the tip region 22 of the blades 12.

Figure 2:
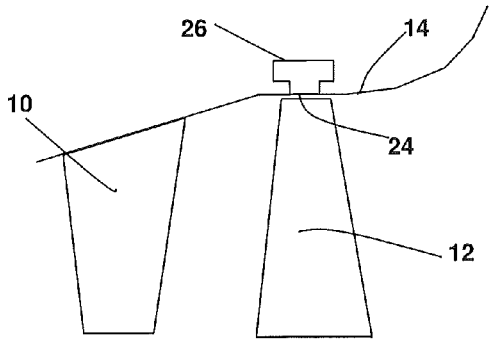
FIG. 2 is a schematic of the steam turbine of FIG. 1 with a Helmholtz resonator.

A resonance chamber 26 is defined as an enclosed space with opening having an interior surface which is configured to reflect pressure waves therein. Waves entering the chamber bounce back and forth within the chamber with low loss. The material of the chamber, particularly that of the actual internal walls, its shape and the position of the opening, as well as the finish (porosity) of the internal walls contributes to the dampening effect of the resonance chamber. In exemplary embodiments the resonance chamber 26 may take any form known the art capable of performing the function of a resonance chamber 26 including a Helmholtz resonator 26 shown in FIG. 2.

It has been found that, in particularly for last stage blades of low pressure turbines, a particularly advantages tuning frequency of the resonance chamber is between 2.5 and 6 engine orders, and more particularly between 3 to 5 engine orders.

Although the disclosure has been herein shown and described in what is conceived to be the most practical exemplary embodiment, it will be appreciated by those skilled in the art that the present disclosure can be embodied in other specific forms. The presently disclosed embodiments are therefore considered in all respects to be illustrative and not restricted. The scope of the disclosure is indicated by the appended claims rather that the foregoing description and all changes that come within the meaning and range and equivalences thereof are intended to be embraced therein.

What is claimed:

1. A steam turbine comprising:

a rotor;

a circumferentially distributed rotating row of blades extending radially from a root of the blades attached to the rotor to a tip portion of the blades;

an outer annulus circumferentially enclosing the row of blades;

a resonance chamber having an opening in a region of the outer annulus defined by a radial projection of the root of the blades onto the outer annulus; and wherein the resonance chamber is configured for a frequency between 2.5 to 6 engine orders; and wherein the resonance chamber is configured as a helmholtz resonator.

2. The steam turbine of claim 1 wherein the opening is opposite the tip portion of the blades.

3. The steam turbine of claim 1 comprising a plurality of circumferentially distributed resonance chambers.

4. The steam turbine of claim 1, wherein the resonance chamber is configured for a frequency between 3 to 5 engine orders.

5. The steam turbine of claim 1 wherein the steam turbine is a multi-stage steam turbine having a downstream last stage wherein the row of blades are last stage blades.

6. The steam turbine of claim 1 wherein the steam turbine is a low pressure steam turbine configured to operate with an exhaust pressure at or below ambient pressure.

* * * * *